US011641944B2

(12) United States Patent
DuFresne

(10) Patent No.: US 11,641,944 B2
(45) Date of Patent: May 9, 2023

(54) DOUBLE ANGLE BACK SUPPORT ADJUSTMENT

(71) Applicant: Anthro Form, LLC, Waukesha, WI (US)

(72) Inventor: Steven DuFresne, Hartland, WI (US)

(73) Assignee: Anthro Form, LLC, Waukesha, WI (US)

( * ) Notice: Subject to any disclaimer, the term of this patent is extended or adjusted under 35 U.S.C. 154(b) by 0 days.

(21) Appl. No.: 17/848,698

(22) Filed: Jun. 24, 2022

(65) Prior Publication Data

US 2023/0022713 A1 Jan. 26, 2023

Related U.S. Application Data

(60) Provisional application No. 63/221,647, filed on Jul. 14, 2021.

(51) Int. Cl.
*A47C 7/46* (2006.01)
*A47C 7/40* (2006.01)

(52) U.S. Cl.
CPC ..... *A47C 7/462* (2013.01); *A47C 7/402* (2013.01); *A47C 7/405* (2013.01)

(58) Field of Classification Search
CPC ..... A47C 7/462; A47C 7/402; A47C 7/405
USPC ..... 297/284.3
See application file for complete search history.

(56) References Cited

U.S. PATENT DOCUMENTS 4,981,325 A 1/1991 Zacharkow
5,176,706 A 1/1993 Lee
5,249,839 A 10/1993 Faiks et al.
5,501,507 A 3/1996 Hummitzch
5,577,811 A 11/1996 Ogg
5,704,689 A * 1/1998 Kim ..... A47C 7/405 297/301.4
6,125,851 A 10/2000 Walker et al.
6,520,577 B2 2/2003 Kitagawa
6,843,530 B1 1/2005 Wu
6,945,601 B1 9/2005 Wu
7,000,987 B2 2/2006 Staarink
7,040,703 B2 * 5/2006 Sanchez ..... A47C 7/405 297/284.4
7,131,700 B2 11/2006 Knoblock et al.
7,347,495 B2 3/2008 Beyer et al.
(Continued)

FOREIGN PATENT DOCUMENTS

CN 209450161 U 10/2019
CN 209883546 U 1/2020
(Continued)

OTHER PUBLICATIONS

International Search Report and Written Opinion of the International Search Authority dated Jan. 4, 2023, received in connection with International Application No. PCT/US2022/036939 filed Jul. 13, 2022.

*Primary Examiner* — Anthony D Barfield
(74) *Attorney, Agent, or Firm* — Boardman & Clark LLP

(57) ABSTRACT

A chair is described herein. The chair includes a first back support coupled to a base of the chair using one or more first support arms. The chair also includes a second back support coupled to the base of the chair using one or more second support arms. The first and second back supports are independently rotatable.

17 Claims, 15 Drawing Sheets

(56) References Cited

U.S. PATENT DOCUMENTS

| | | | | |
|---|---|---|---|---|
| 7,585,028 | B2 * | 9/2009 | Jenkins | A47C 7/462 297/284.7 |
| 7,625,046 | B2 * | 12/2009 | Sanchez | A47C 7/402 297/217.2 |
| 7,841,666 | B2 | 11/2010 | Schmitz et al. | |
| 7,878,591 | B2 | 2/2011 | Walker et al. | |
| 8,167,371 | B2 | 5/2012 | Underwood | |
| 8,398,170 | B2 | 3/2013 | Walker | |
| 8,632,129 | B2 | 1/2014 | Huttenhuis | |
| 9,326,608 | B1 | 5/2016 | Hoy et al. | |
| 9,675,179 | B2 | 6/2017 | Walker | |
| 9,833,076 | B2 | 12/2017 | Walker et al. | |
| 10,226,129 | B2 | 3/2019 | Christianson et al. | |
| 10,258,820 | B2 | 4/2019 | Barlow | |
| 10,264,890 | B2 | 4/2019 | Aldrich et al. | |
| 10,299,602 | B2 | 5/2019 | Wu | |
| 10,555,611 | B2 | 2/2020 | Mullen et al. | |
| 10,758,051 | B2 | 9/2020 | Walker et al. | |
| 2003/0197407 | A1 | 10/2003 | Sanchez | |
| 2005/0046258 | A1 | 3/2005 | Sanchez | |
| 2005/0189810 | A1 | 9/2005 | Wu | |
| 2006/0138821 | A1 | 6/2006 | Pan | |
| 2007/0106188 | A1 | 5/2007 | Walker | |
| 2007/0236066 | A1 | 10/2007 | Sanchez | |

FOREIGN PATENT DOCUMENTS

| | | | |
|---|---|---|---|
| DE | 102008051223 | A1 | 4/2010 |
| DE | 102019128827 | A1 | 4/2020 |

* cited by examiner

DOUBLE ANGLE BACK SUPPORT ADJUSTMENT

CROSS-REFERENCE TO RELATED APPLICATIONS

This application claims the benefit of U.S. Provisional Patent Application No. 63/221,647 filed Jul. 14, 2021, entitled "DOUBLE ANGLE BACK SUPPORT ADJUSTMENT," the entire content of which is hereby incorporated by reference herein in its entirety.

BACKGROUND

Some chairs include a back support that can be adjusted using an angle adjuster. Such chairs may enable the user to set the angle of the back support, while other chairs merely allow the back support to pivot relative to the seat. In many chairs that enable the user to set the angle of the back support, the back support is a single back support and can only be set to a single angle. Further, while the angle of the back support may be changed, the relative lateral position cannot be changed while keeping the back support relatively perpendicular to the seat of the chair. Additionally, many chairs include only a single back support. A single back support, even with a lumbar feature, is often unable to support a variety of body shapes while also following typical movement and/or achieving a neutral posture of the thoracic and pelvic areas of the user. A solution is needed for a mechanism and/or method that is capable of adjusting one or more back supports that are independently movable.

SUMMARY

Described herein is a chair that includes one or more back supports. The back supports of the chair are connected to a base of the chair such that each back support is independently movable. The back supports may also be connected in a way such that each back support rotates about the same pivot axis on the chair. Support arms for each of the back supports are shaped and/or arranged in such a way that the support arms of one back support will not interfere with the support arms of another back support so that each back support can be pivoted throughout the typical range of motion for the pelvis through the cervical spine of a user.

An example chair is described herein. The example chair includes a first back support and a second back support. The first back support is connected to a base of the chair with first support arm(s). The second back support is connected to the base of the chair with second support arm(s). The first and second back supports are independently movable and rotatable and/or height adjustable.

A back support adjustment mechanism for a chair is also described. The back support adjustment mechanism includes a first connection point for first support arm(s), the first support arm(s) supporting a first back support. A first adjustment device is coupled to the first support arm(s). The back support adjustment mechanism also includes a second connection point for second connection arm(s), the second support arm(s) supporting a second back support. A second adjustment device is coupled to the second support arm(s). The number of support arms for the first support arm(s) and the second support arm(s) can be one, two, or even more.

BRIEF DESCRIPTION OF THE DRAWINGS

Various examples of embodiments of the systems, devices, and methods according to this invention will be described in detail, with reference to the following figures.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
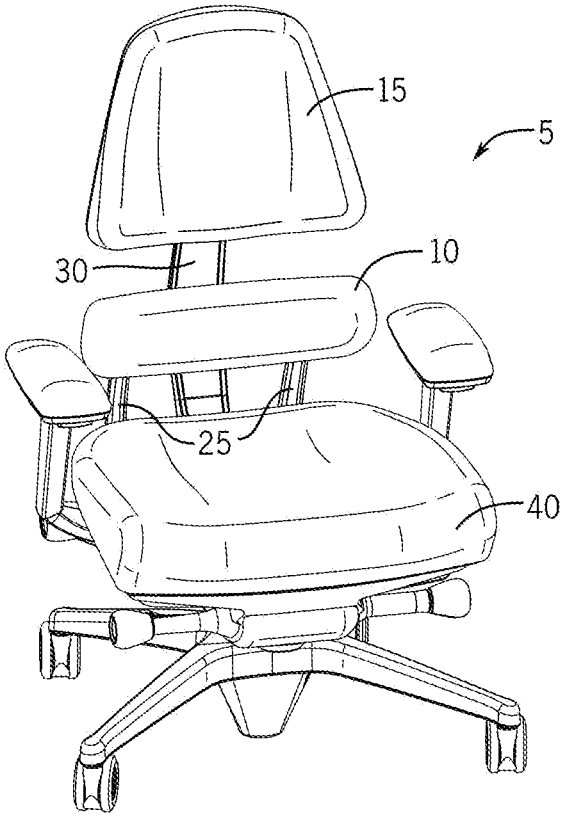
FIG. 1 depicts a perspective view of an example chair including two back supports and a double angle adjustment knob.
Figure 2:
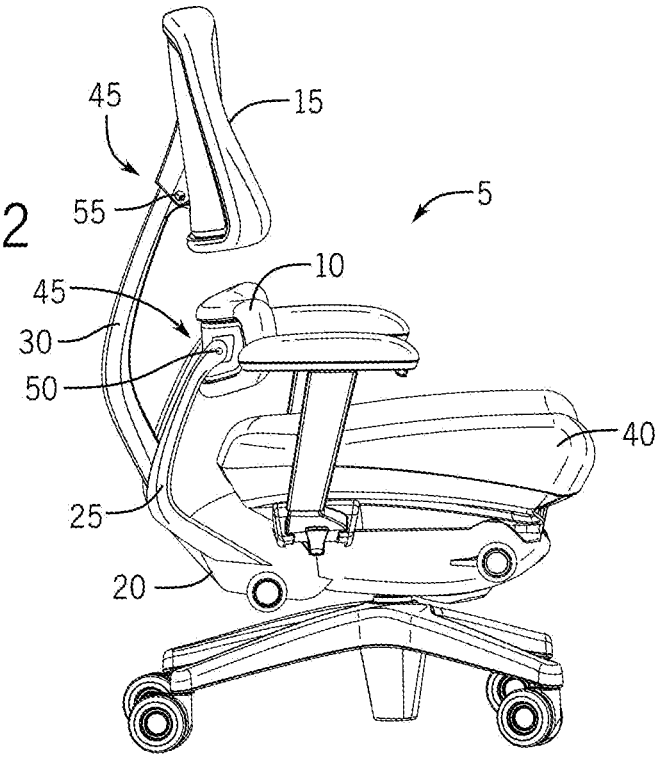
FIG. 2 depicts a left side view of the example chair of FIG. 1.
Figure 3:
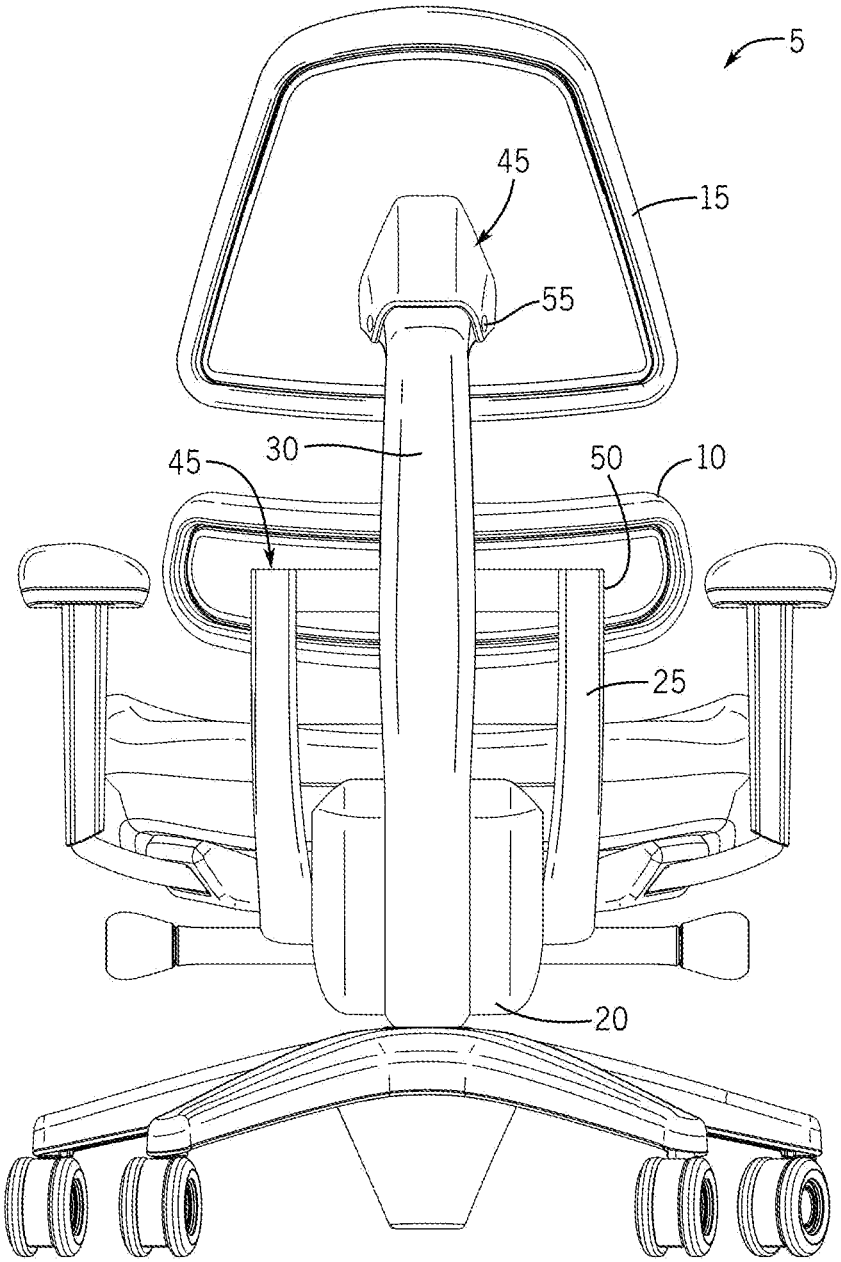
FIG. 3 depicts a rear view of the example chair of FIG. 1

FIG. 1 is a perspective view of an example chair 5 including a first back support 10 and a second back support 15. The first back support 10 is a lower back or pelvic support coupled to a base support 20 structure via one or more support arms 25 (e.g., first support arm(s)). The second back support 15 is an upper back support or thoracic support coupled to the base support 20 structure via one or more support arms 30 (e.g., second support arm(s)). In other examples, the first and second back supports 10, 15 may alternatively be a lumbar support, a mid-back support, and/or a head/neck support. In some examples, additional back supports may be connected to the base support 20 structure via one or more additional support arms. In some examples, one or more frames may be used to couple the back supports to the chair the back supports may be independently movable on each frame. The example frames may be connected to the base such that the frames are each pivoted around a common axis. As shown in FIGS. 2 and 3, the first and second back supports 10, 15 are separately connected to a base support 20 structure of the chair 5. That is, the first and second back supports 10, 15 are not connected to one another other than at the single, common pivot point, such that the second back support 15 is not connected to the base support 20 via the first back support 10, nor is the second back support 15 coupled to the first back support 10, which makes the first and second back supports 10, 15 independently movable.

In the illustrated example construction, the first and second support arms 25, 30 are coupled to the base support 20 at the same pivot axis. That is, each of the first and second support arms 25, 30 pivot around the same axis to adjust an angle of the respective first back support 10 and second back support 15. Any additional support arms for additional back supports may also be coupled to the base support 20 such that the additional support arms rotate about the same pivot axis (e.g., a common axis). In some examples, the first and second support arms 25, 30 are coupled to a single rod or pin, as depicted in the example construction of FIGS. 4 and 5. Alternatively, each of the example first and second support arms 25, 30 may be coupled to a different rod or pin and each of the rods or pins are aligned along the same pivot axis.

The first and second support arms 25, 30 are independently movable such that the first and second back supports 10, 15 can move independently relative to each other through a broad range of motion. That is, the first and second support arms 25, 30 allow independent forward and backward movement of each of the first and second back supports 10, 15 relative to a seat 40 of the chair 5 by adjusting the angle of the respective first and second support arms 25, 30. In some examples, to enable the independent forward and backward movement of the first and second back supports 25, 30, the first support arm(s) 25 are offset from a center of the first back support 10 and positioned on either side of the second back support 15 so that the first and second support arms 25, 30 do not interfere with one another when the first and second back supports 10, 15 are adjusted. The example first and second support arms 25, 30 may also be shaped (e.g., curved, angled, etc.) to allow this independent movement through a broad range of angles without interference. For example, the range of motion for the first and/or the second back support 10, 15 may be a total of 200 degrees, and, for example, may be 20 degrees forward and 180 degrees backward. In the particular illustrated example, the total range of motion for the second back 15 support is 16 degrees, for example 4 degrees in the forward direction (e.g., from a right angle to a horizontal plane) and 12 degrees in the backward direction (e.g., from a right angle to a horizontal plane). Additionally, the second back support 15 is biased about a pivot point in a 4 degree backward tilt and is pivotable 10 degrees in either direction. In the illustrated example, the total range of motion for the first back support 10 is 22 degrees, for example 11 degrees in the forward and 11 degrees in the backward direction. Furthermore, the broad range of motion enabled by the first and second support arms 25, 30 also enables the angle of the first and second support arms 25, 30 to be acute (e.g., less than 90 degrees relative to the seat 40). Thus, one or both of the first and second back supports 10, 15 can be adjusted such that the back support 10, 15 is positioned at least partially over the seat 40 of the chair 5.

Alternatively, a single support arm may be used for the first back support 10 and two offset support arms may be used for the second back support 15 and positioned on either side of the single support arm. In other examples, one support arm may be used for each of the first and second back supports 10, 15 and one or both of the support arms 25, 30 may be curved in a way to prevent interference while also contacting a center portion of each of the back supports 10, 15. In further alternative examples, each of the back supports 10, 15 may be coupled to the base support structure using multiple support arms.

Additionally, each of the first and second back supports 10, 15 may be independently height adjustable. The example first and second support arms 25, 30 may be extendible to adjust the height of the respective first and second back supports 10, 15. In some examples, the first and second back supports include a number of apertures through which a pin is positioned to adjust the height of the respective back supports to different levels, as depicted in the example construction of FIGS. 4 and 5. Alternatively, a top end 45 of each respective first and second support arms 25, 30 may be slidable along the connection area to the respective first and second back supports 10, 15. That is, the top 45 of the first support arm(s) 25 may be coupled to the first back support 10 via a track or track-like connection that enables the first back support 10 to slide up and down along the track. The second back support 15 may be, but are not necessarily, coupled to the second support arm(s) 30 using a similar track. Additionally, the example first and second support arms 25, 30 may be pivotably connected to the respective first and second back supports 10, 15. For example, the top 45 end of each of the first and second support arms 25, 30 may include a pin 50, 55 around which the respective first or second back support 10, 15 is rotatable. Due to the first and second back supports 10, 15 being pivotably connected to the respective first and second support arms 25, 30, the first and second back supports 10, 15 can be moved forward and backward while enabling the first and second back supports 10, 15 to be oriented relatively perpendicularly to the seat 40 of the chair 5.

Figure 4:
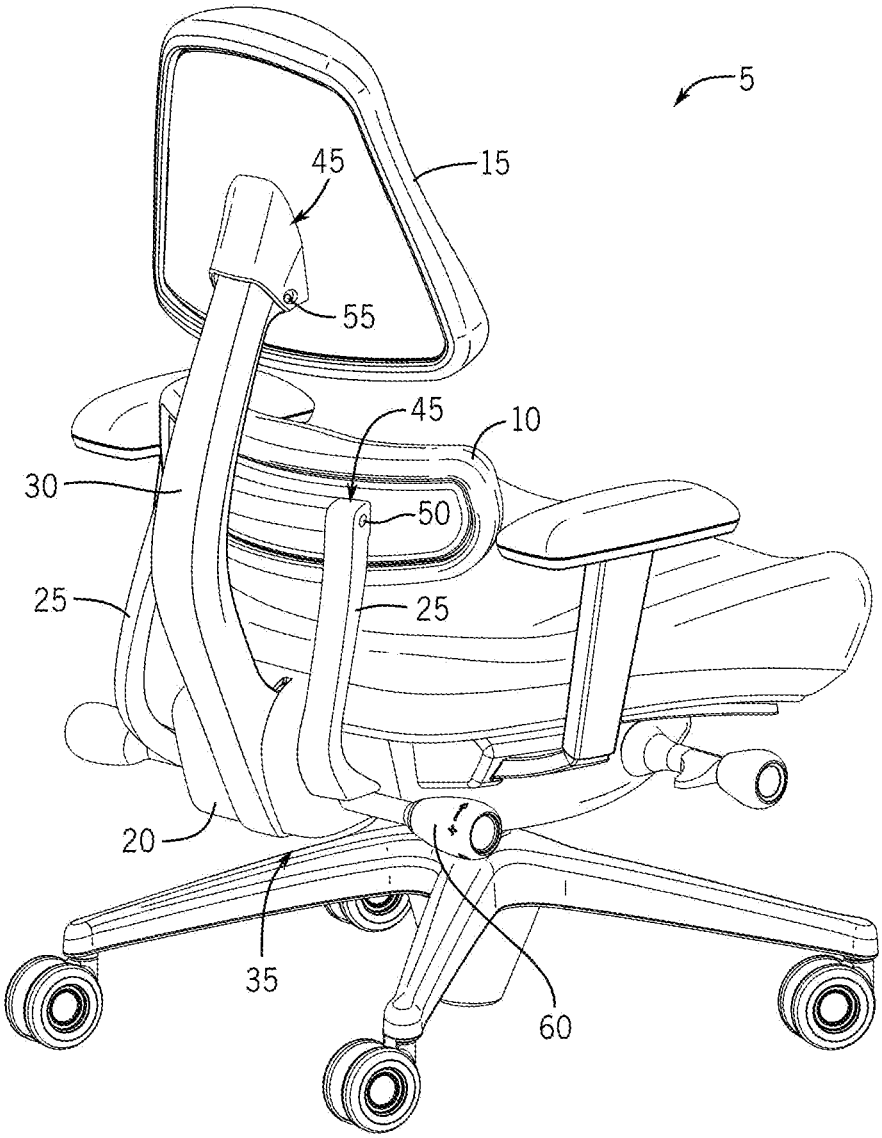
FIG. 4 depicts a rear perspective view of an example double back angle adjustment knob that may be used with the example chair of FIG. 1
Figure 5:
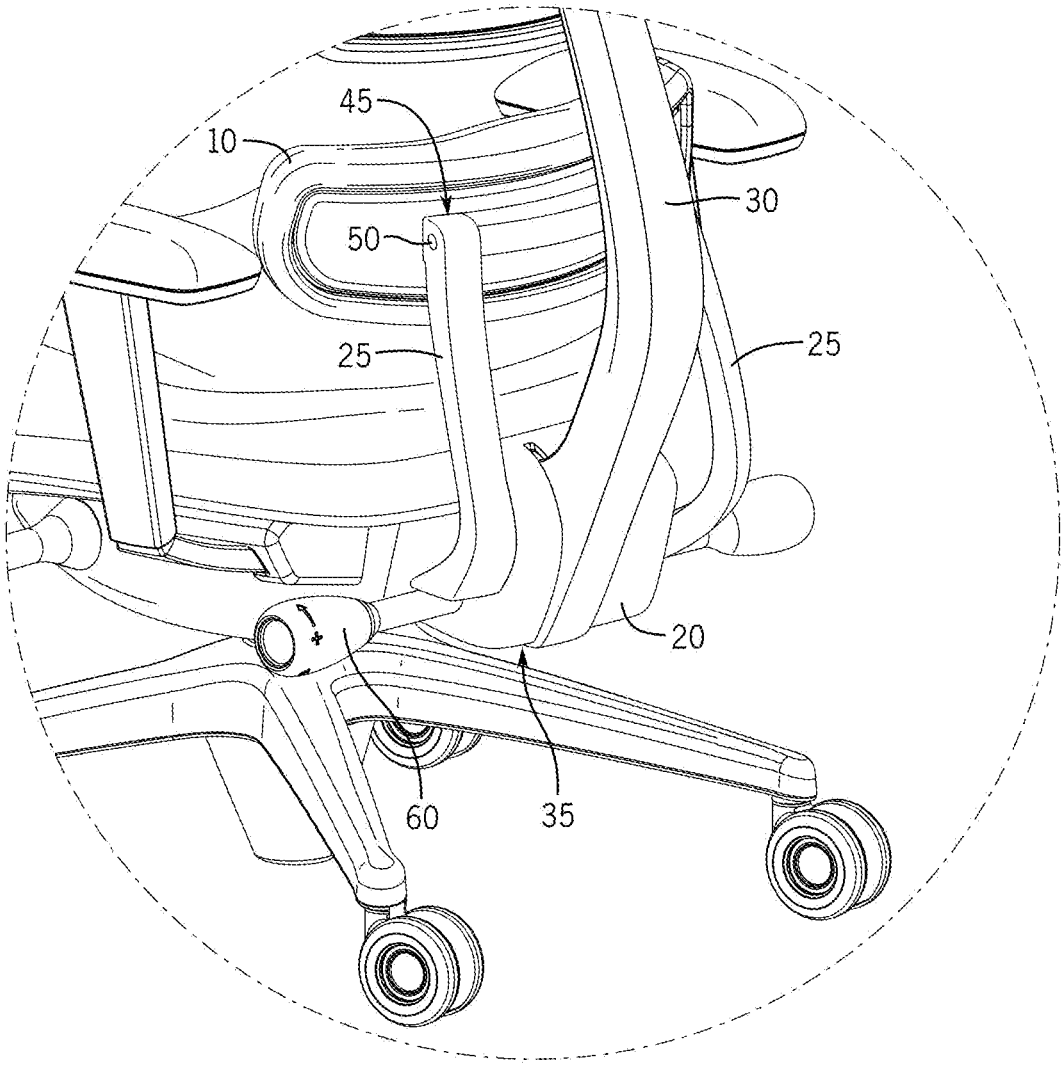
FIG. 5 depicts a more detailed view of the double back angle adjustment knob that may be used with the example chair of FIG. 1.

In the illustrated example of FIGS. 4 and 5, the first and second support arms 25, 30 are coupled to a single rod. A handle 60 is rotated in a first direction to allow the back support(s) to move freely (e.g., an unlocked position) and the handle 60 is rotated in a second direction to secure the back support(s) (e.g., a locked position). When the handle 60 is in the unlocked position, the angle of each of the first and second support arms 25, 30 can be adjusted to move the first and second back supports 10, 15 to a desired position. The handle 60 is then moved into the second position to lock the first and second back supports 10, 15 in the desired position. Thus, in this example, the first and second back supports 10, 15 may be moved simultaneously even though the support arms 25, 30 are independently movable. For example, FIG.

Figure 6:
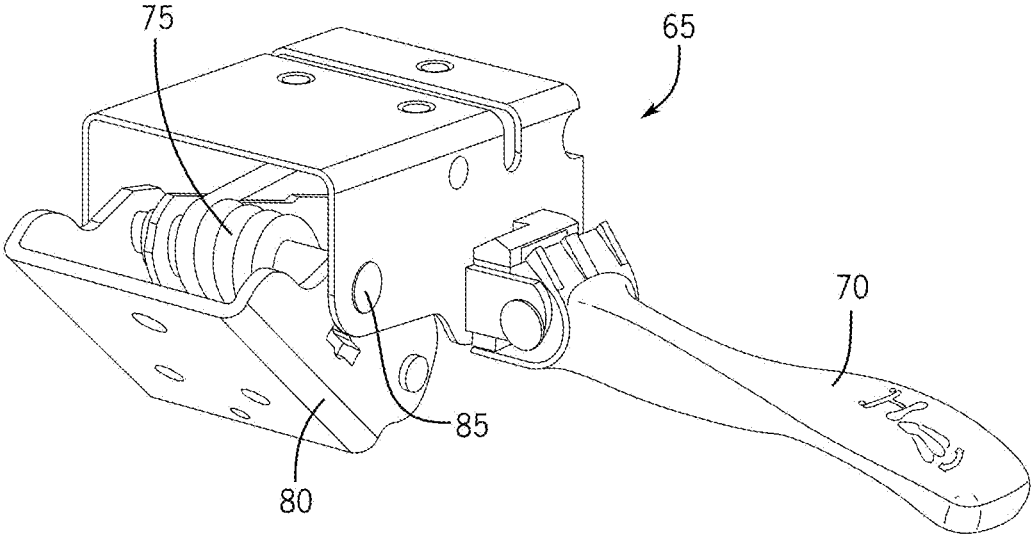
FIG. 6 depicts an existing angle adjuster.

6 depicts an existing back angle adjuster 65 that can be used to adjust a single back support. In the example depicted in FIG. 6, two of the described devices may be used to adjust the back support(s). A lever 70 unlocks movement of the back support (e.g., via a support arm connector 80) and a spring 75 biases the back support(s) forward. When the back support(s) are moved to a desired position, the lever 60 is moved to lock movement of the back support(s) 10, 15. A similar back angle adjuster can be used with two back supports by extending the length of a pin and adding an additional support arm connector. For example, the back angle adjuster may include a first connection point (e.g., along the pin) for the first support arms 25 and a second connection point (e.g., along the pin) for the second support arms 30. In some examples, the back angle adjuster may include two adjustment devices (e.g., levers or knobs), each lever or knob to be operated to allow the user to adjust one of the back supports 10, 15. For example, a first lever may unlock or unblock movement of the first back support 10 and a second lever may unlock or unblock movement of the second back support 15.

While one example method of adjusting the angle of the first and second support arms 25, 30 is described, almost any other known method of adjusting a single back support may be used to adjust two back supports 10, 15 independently. For example, the first and second support arms 25, 30 may be adjusted using knobs (e.g., tension knobs) that a move a cam, which in turn moves each of the support arms 25, 30 to adjust the back support. In this example, the first and second support arms 25, 30 may be adjusted using two separate cams (motorized or manually powered). In some such examples, the respective cams are positioned on separate rods so that the user can adjust the first and second back supports 10, 15 separately from one another by turning the knob. In some examples, the separate pins or rods are aligned on different axis, while the pivot axis of both the first support arm(s) and the second support arm(s) 25, 30 is a common axis which may or may not correspond with one of the axis of the pins or rods. Alternatively, the separate pins or rods are aligned on the same axis, which may also correspond with the common pivot axis of the first support arm(s) and the second support arm(s) 25, 30.

In alternative examples, a single knob adjustment may be moved laterally to a first position to adjust the first support arm(s) 25 or to a second position to adjust the second support arm(s). Using a knob-type adjustment device also enables the back support 10, 15 to be locked in place or not movable without turning the knob so that each back support 10, 15 stays in the position to which the user adjusts each back support. Thus, in some examples, the first and second back supports 10, 15 may be moved individually (e.g., one at a time) while still allowing independent movement of the first and second support arms 25, 30.

In some alternative examples, the angle adjustment of each or both back supports 10, 15 and support arms 25, 30 can be done using a combination of levers and gears. In other alternative examples, the angle of each of the support arms 25, 30 may be adjusted using a combination of clutch disks and corresponding cams. Alternatively, a single adjustment feature may be capable of adjusting both the first and second support arms 25, 30 and, thus, the first and second back supports 10, 15. For example, the knob may operate a cam or other movable feature to adjust both the first and second support arms 25, 30 simultaneously.

In some examples, a chair may include a second back support as described above (e.g., a traditional back support, and in some examples with a curved support member) and a first back support that moves backward and forward using a different method. In these such examples, the first back support is coupled to the seat using a vertical adjustment mechanism (VAM) oriented in a horizontal plane. The VAM moves an inner frame or track member along an outer frame or track member along a pre-determined adjustment length at predetermined intervals. For example, in a VAM with a predetermined length of two inches, each predetermined interval is a quarter inch, resulting in eight different intervals or positions. In other examples, the first and second back supports may move forward and backward simultaneously. In one such example, the first and second back supports are coupled to a seat slider. In other constructions, the first and second back supports may move backward and forward using a series of clutch plates, or any combination of the above.

Figure 7:
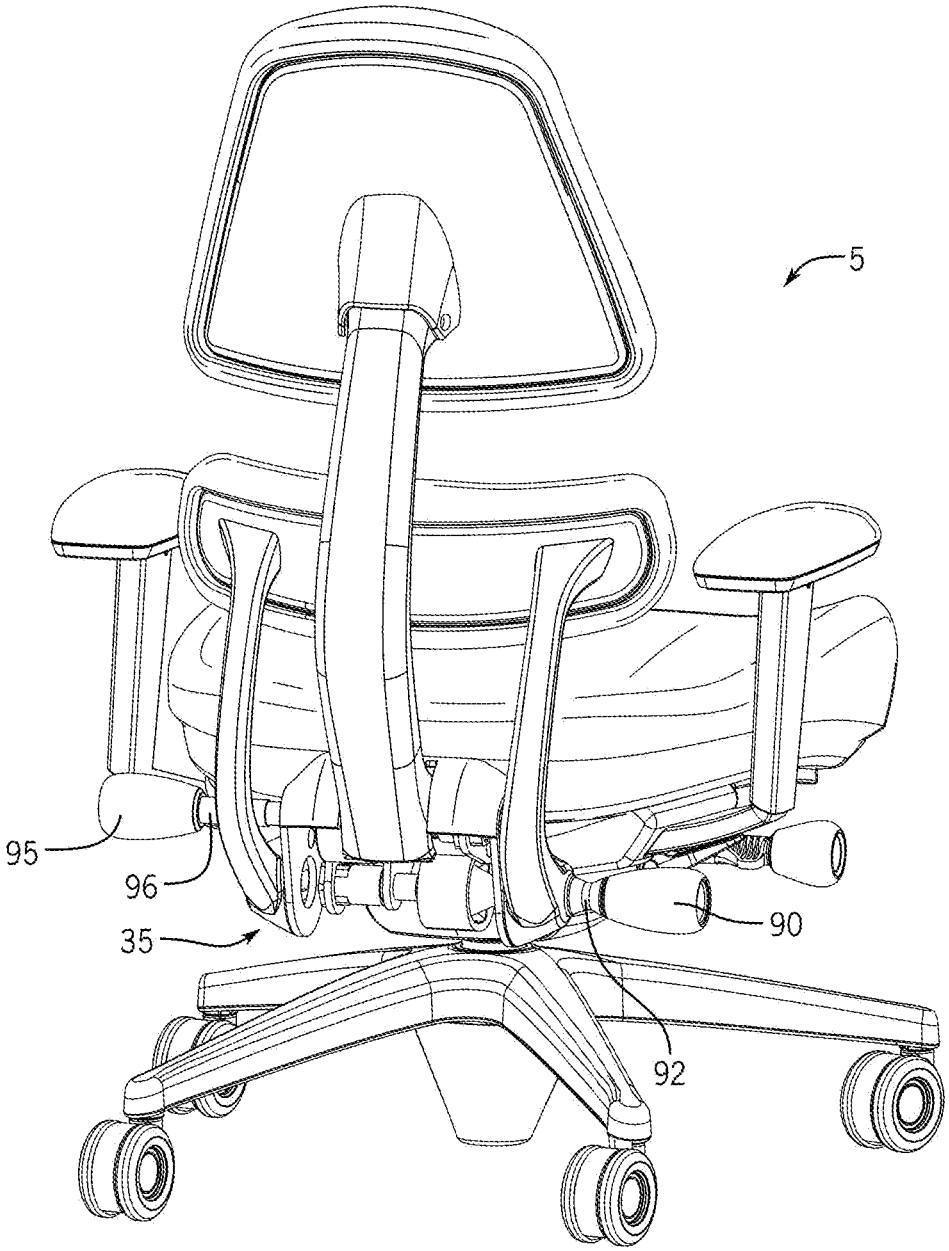
FIG. 7 depicts an example chair similar to the chair of FIGS. 1-5 that includes a back angle adjustment mechanism for two back supports, as described herein.

FIG. 7 depicts an example chair 5 similar to the chair of FIGS. 1-5 that includes a back angle adjustment mechanism 35 for two back supports, as described herein. As depicted in FIG. 7, the example chair includes a first adjustment knob 90 connected to a rod 92 and a second adjustment knob 95 connected to a rod 96. In the illustrated example, the adjustment knobs 90, 95 are positioned on opposite sides of the chair. However, in some examples, the adjustment knobs 90, 95 may be positioned on the same side of the chair. The example knobs 90, 95 are rotatable (e.g., turned by the user, turned by a motor) to adjust a position of a respective back support. For example, the first adjustment knob 90 adjusts the first back support 10 and the second adjustment knob 95 adjusts the second back support 15. In some examples, the knobs 90, 95 may also move laterally (e.g., along a respective rotation axis) as the knob 90, 95 is rotated. Alternatively, the knobs 90, 95 may be move laterally by the user to adjust the position of the respective first and second back supports 10, 15. Additionally, a cover (not shown) may be positioned over the example back angle adjustment mechanism to cover any pinch points that may exist between any moving components.

Figure 8:
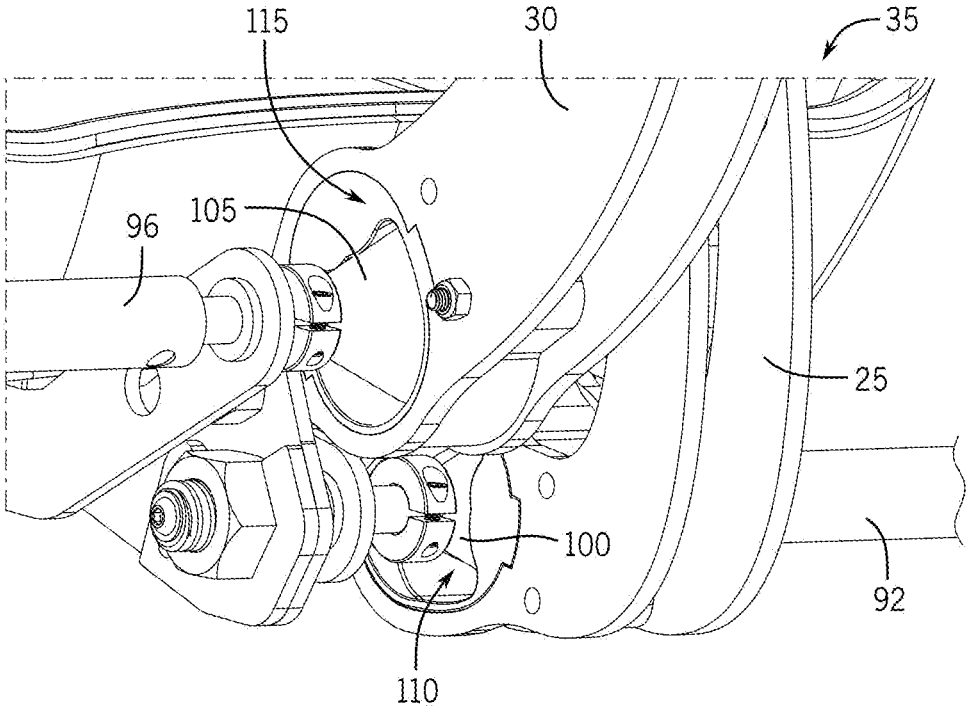
FIG. 8 is a more detailed view of the example back angle adjustment mechanism of FIG. 7.

FIG. 8 is a more detailed view of the example back angle adjustment mechanism 35 of FIG. 7. FIG. 8 depicts a first cam 100 that is connected to the first adjustment knob 90 and the second cam 105 that is connected to the second adjustment knob 95. Each example cam 100, 105 is positioned within a corresponding cam receiver 110, 115 that is affixed to a lower portion of a respective support arm 25, 30. That is, the first adjustment knob 90 operates the first cam 100, which interacts with the first cam receiver 110 to move the first support arm(s) 25. Similarly, the second adjustment knob 95 operates the second cam 105, which interacts with the second cam receiver 115 to move the second support arm(s) 30. While two adjustment knobs 90, 95 and cams 100, 105 are depicted, any number may be used, so long as the number corresponds with the number of back supports to be adjusted.

Figure 9:
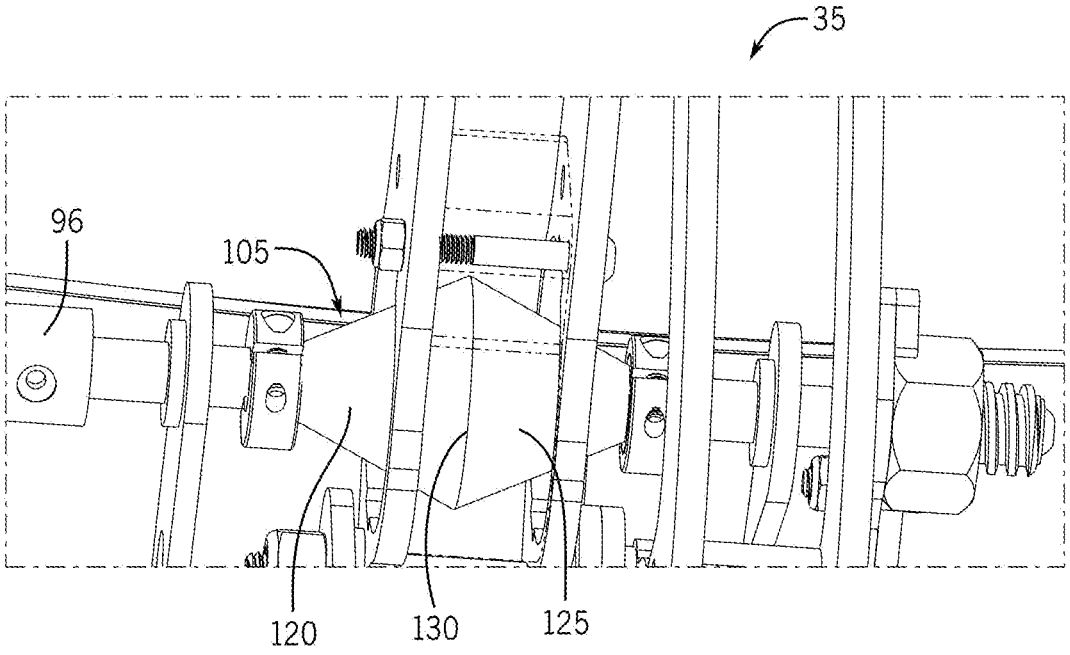
FIG. 9 depicts a detailed view of an example cam that may be used with the back angle adjustment mechanism of FIGS. 7 and 8.

FIG. 9 depicts a detailed view of one of the example cams 100, 105 that may be used with the back angle adjustment mechanism 35 of FIGS. 7 and 8. The example cams 100, 105 each have a double truncated conical structure. Specifically, each cam 100, 105 includes a first truncated conical 120 portion abutting a second truncated conical portion 125 at the larger diameter 130 end. The angle of the conical portions 125, 130 is the same and may be varied based on the desired range of motion for the respective support arms 25, 30 and required torque input for the adjustment rod 92, 96.

Figure 10A:
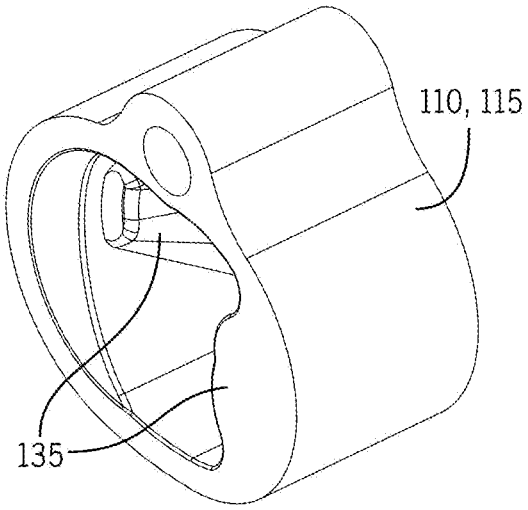
FIGS. 10A and 10B is a more detailed view of an example cam receiver that may be used with the back angle adjustment mechanism of FIGS. 7-9.
Figure 10B:
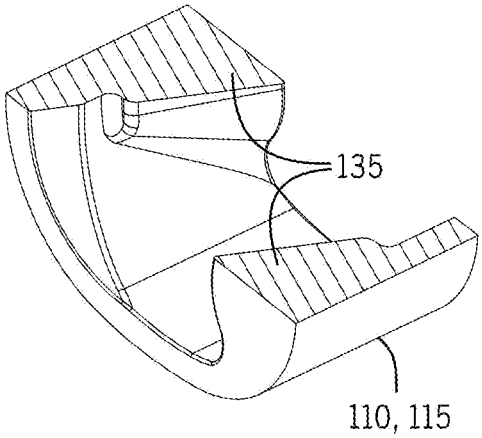

FIGS. 10A and 10B are additional more detailed view of the example back angle adjustment mechanism 35 of FIGS.

7-9. More specifically, FIG. 10A depicts the cam receiver in detail 110, 115 and FIG. 10B is a cross-section of the cam receiver 110, 115. The corresponding cam receivers 110, 115 each include two ramped portions 135 having an angle that corresponds to the angle of the conical structure. The two ramped portions 135 are positioned opposite one another (e.g., spaced 180 degrees apart). The two ramped portions 135 are oriented in opposite directions. That is, the ramp of one ramp portion 135 is sloped toward the adjustment knob 90 or 95 and the ramp of the other ramp portion 135 is sloped away from the adjustment knob 90 or 95. As the cam 100, 105 moves laterally through the cam receiver 110, 115, the interaction between the cam 100, 105 and the ramped portions 135 of the cam receiver 110, 115 cause the support arms 25, 30 fixed to the cam receiver 110, 115 to rotate.

Figure 11:
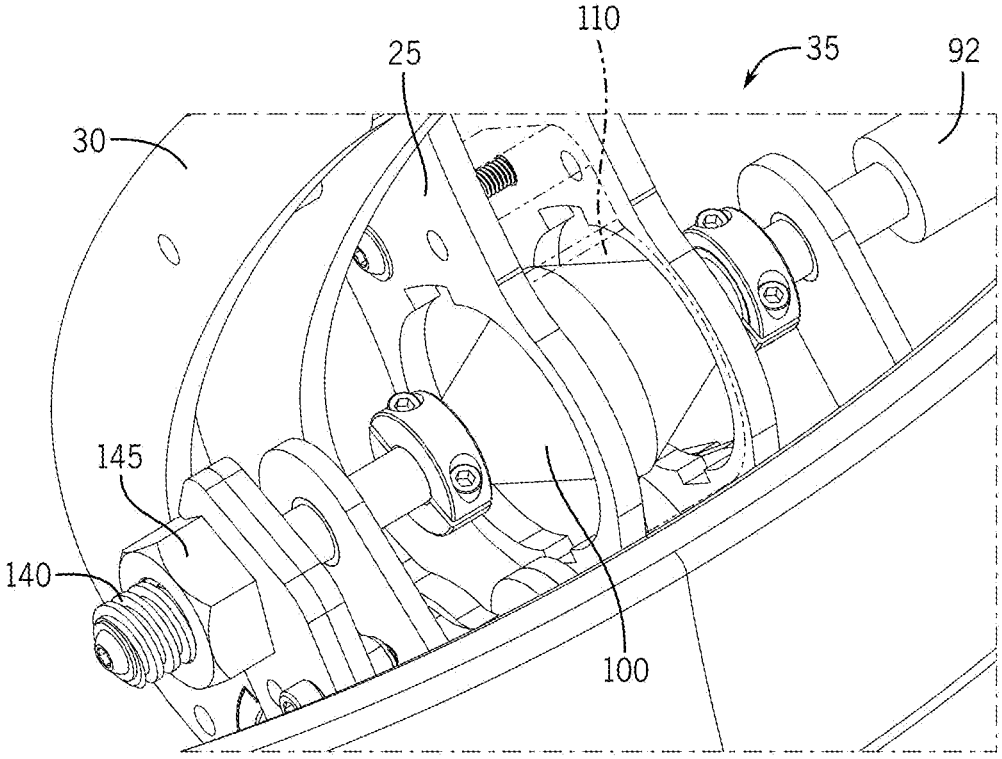
FIG. 11 depicts an additional detailed view of the example cam that may be used with the back angle adjustment mechanism of FIGS. 7-10B.

FIG. 11 depicts an additional detailed view of the example cam 100, 105 that may be used with the back angle adjustment mechanism 35 of FIGS. 7-10. A threaded portion 140 is coupled to or machined into each of the rods 92, 96 of the respective adjustment knobs 90, 95. In the illustrated example, the threaded portion 140 is on the opposite side of the cam 100, 105 from the adjustment knob 90, 95, but alternatively may be positioned on the same side of the cam 100, 105, or threaded portions 140 may be positioned on each side of the cam 100, 105. As the adjustment knob 90, 95 is rotated, the threaded portion 140 interacts with a corresponding threaded portion of a nut 145, thereby causing lateral movement of the rod 92, 96, including the cam 100, 105. As shown in FIG. 11, the adjustment knob 90, 95 has been rotated such that the threaded portion 140 of the rod 92, 96 has moved the rod 92, 96 laterally. The threaded portion 140 acts as a worm gear and thus, prevents back drive of the system or undesired backward motion of the back support 10, 15 when force is applied to the back support 10, 15 or corresponding support arms 25, 30.

Figure 12:
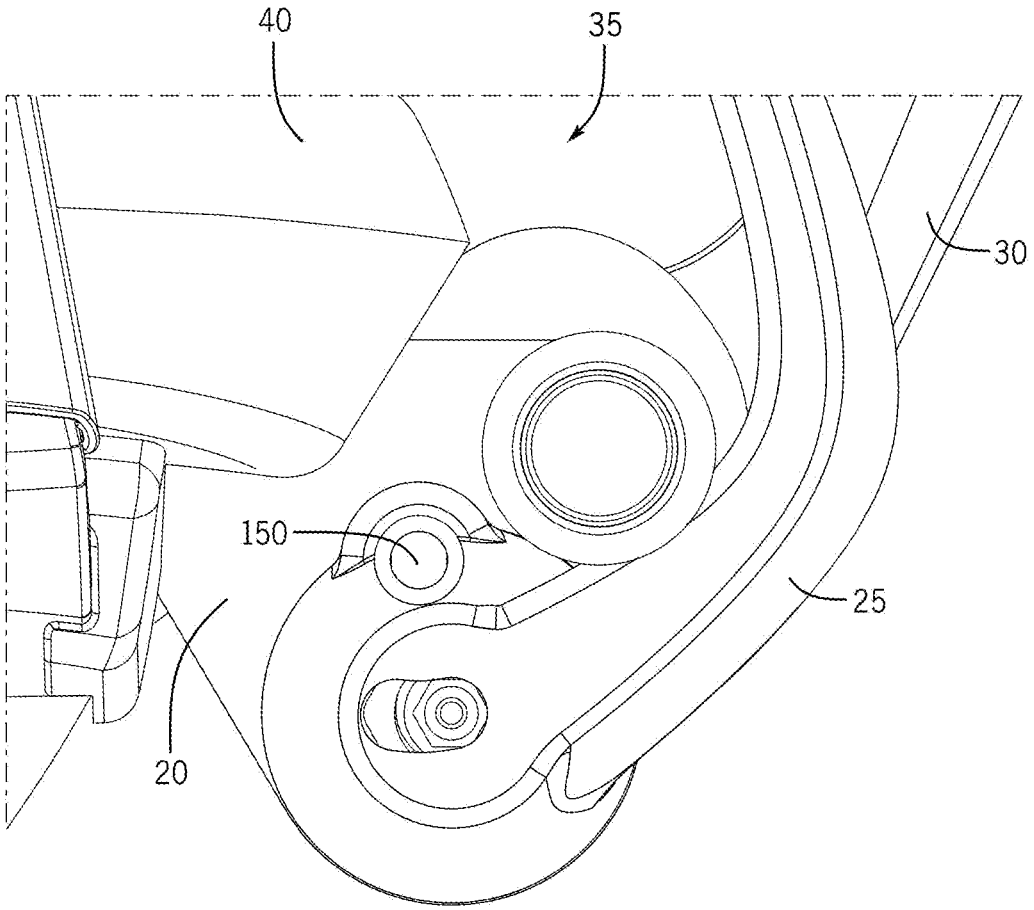
FIG. 12 depicts a side view of the example chair with the example back angle adjustment mechanism of FIG. 7.

FIG. 12 depicts a side view of the example chair with the example back angle adjustment mechanism 35 of FIG. 7. FIG. 12 depicts an opening 150 through which a pin or rod may be positioned. This pin or rod extends through corresponding apertures (aligned with the opening) in both support arms 25, 30. The pin or rod may also be operative to couple the support arms 25, 30 to respective brackets extending from a base 20 or seat pan of the chair 5. While the interaction of the cam 100, 105 and cam receiver 110, 115 dictate the degree of rotation of each of the respective support arms 25, 30, the supports arms 25, 30 rotate about the pin (e.g., a central axis of the pin). Thus, the support arms rotate about a single pivot axis. Alternatively, the support arms 25, 30 may be coupled to the chair 5 in a way such that the support arms 25, 30 are rotated about separate pins or axis.

Figure 13:
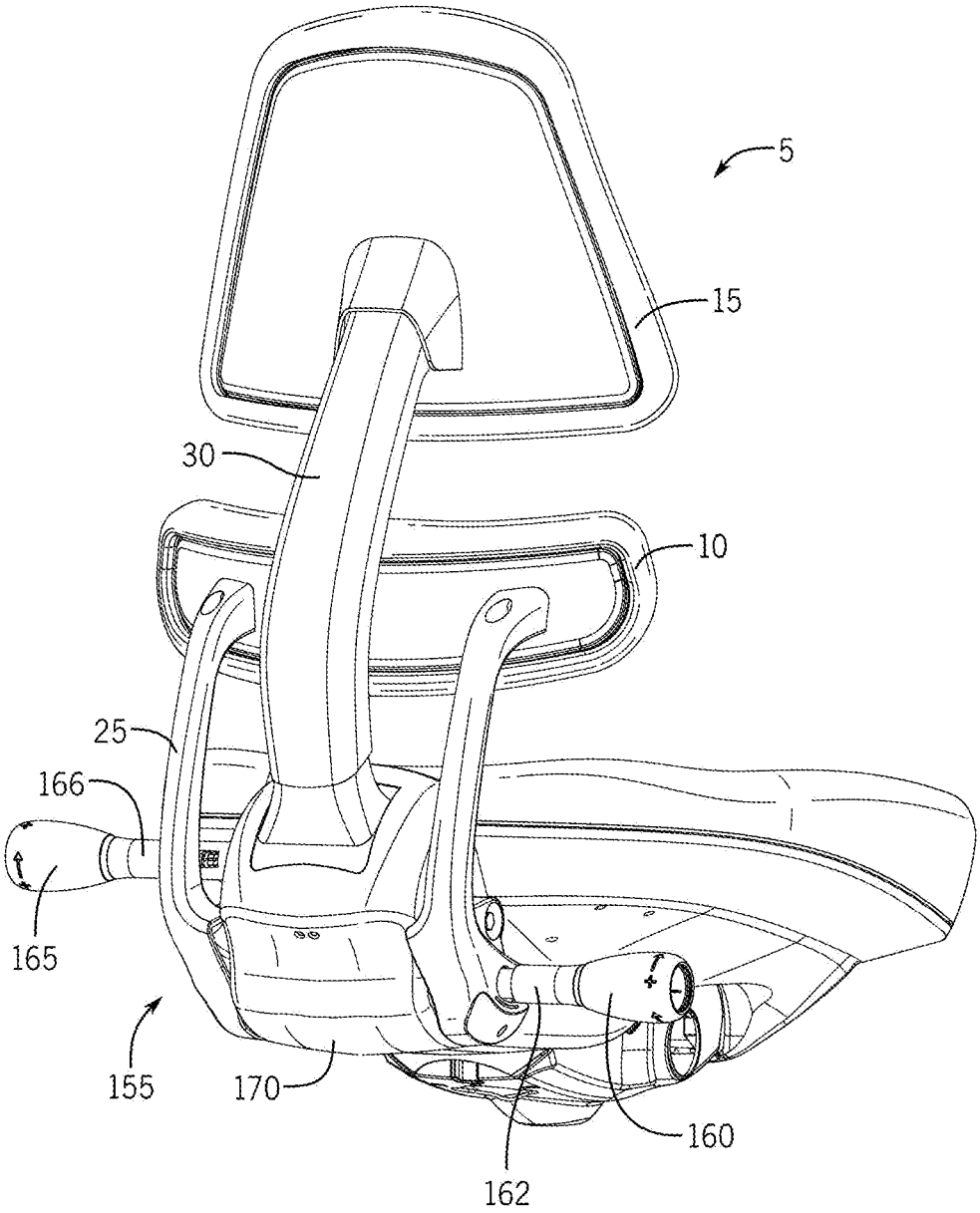
FIG. 13 depicts another example chair similar to the chair of FIGS. 1-5 that includes an alternative back angle adjustment mechanism for two back supports, as described herein.

FIG. 13 depicts another example chair 5 similar to the chair of FIGS. 1-5 that includes an alternative back angle adjustment mechanism 155 for two back supports 25, 30, as described herein. The example back angle adjustment mechanism 155 depicted in FIG. 13 includes a first adjustment knob 160 connected to a first rod 162 corresponding to the first back support 10 and a second adjustment knob 165 connected to a second rod 166 corresponding to the second back support 15. A cover 170 is positioned over the moving components of the back angle adjustment mechanism 155 to cover any pinch points that may exist between any moving components. The cover 170 may also include one or more bushings which hold the one or more rods 162, 166 and/or the cover 170 may hold one or more other components in place.

Figure 14:
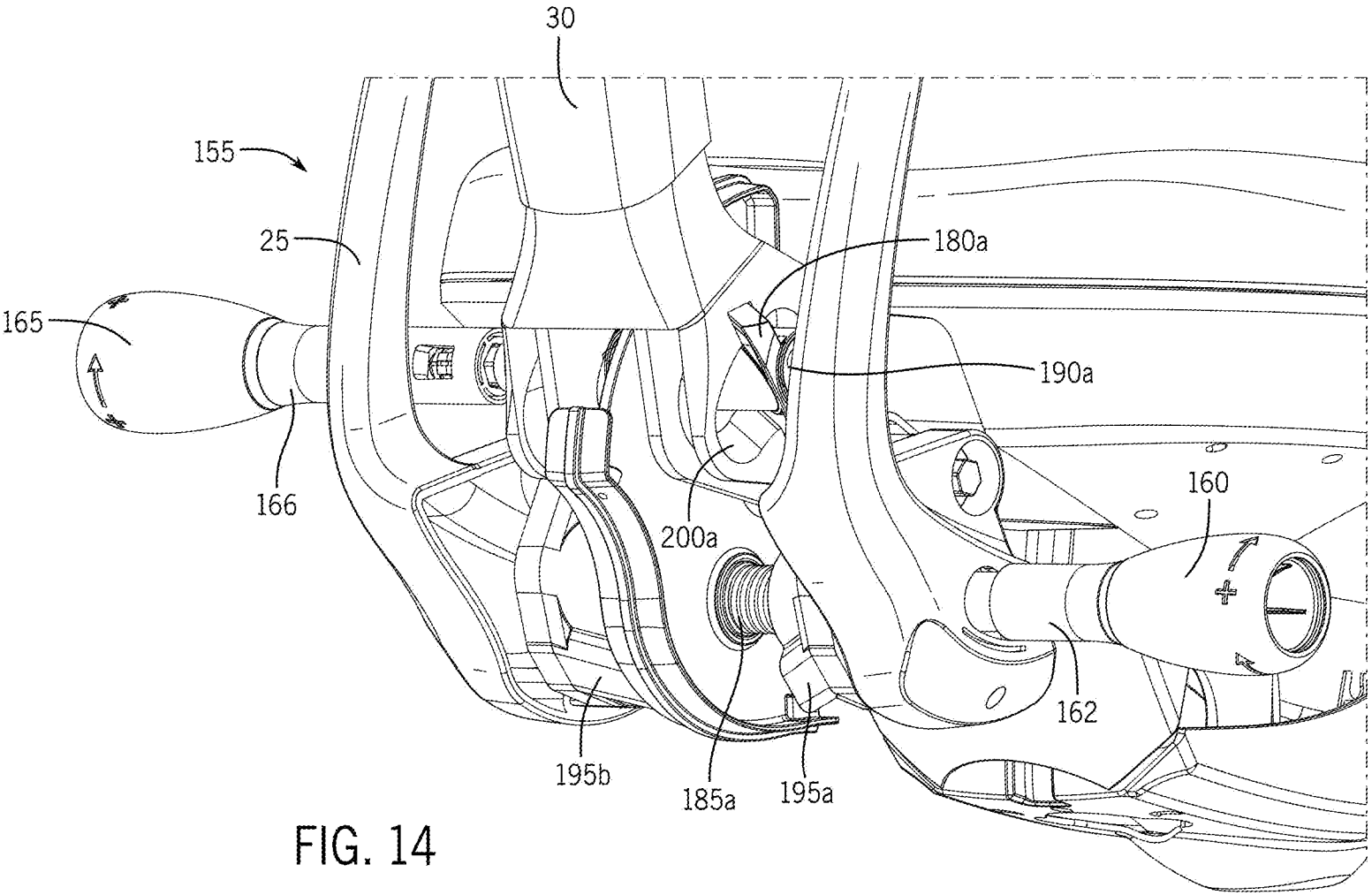
FIG. 14 depicts a more detailed view of the example back angle adjustment mechanism of FIG. 13.
Figure 15:
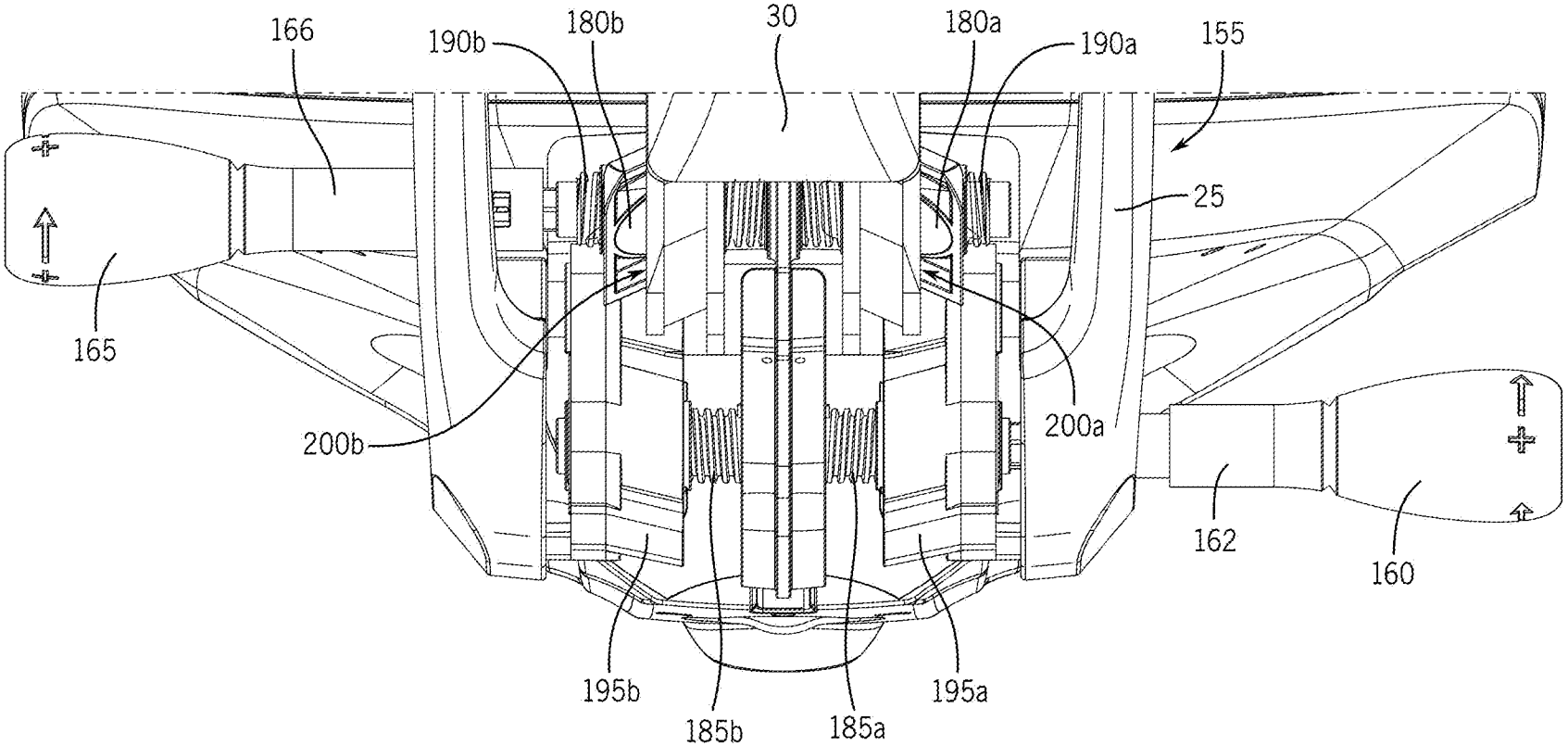
FIG. 15 depicts a rear view of the example back angle adjustment mechanism of FIGS. 13 and 14.

FIG. 14 depicts a more detailed view of the example back angle adjustment mechanism 155 of FIG. 13. FIG. 15 depicts a rear view of the example back angle adjustment mechanism 155 of FIGS. 13 and 14. The example back angle adjustment mechanism 155 includes one or more cam features 175*a*, 175*b*, 180*a*, 180*b* corresponding to each adjustment knob 160, 165. The rod 162, 166 connected to each adjustment knob 160, 165 is coupled to the corresponding cam feature(s) 175*a*, 175*b*, 180*a*, 180*b*, and includes at least one threaded portion. In the illustrated example, the rods 162, 166 each include two threaded portions 185*a*, 185*b*, 190*a*, 190*b*, specifically one right hand threaded portion and one left hand threaded portion. Each cam feature 175*a*, 175*b*, 180*a*, 180*b* is positioned in a corresponding cam receiver 195*a*, 195*b*, 200*a*, 200*b*. Each cam receiver 195*a*, 195*b*, 200*a*, 200*b* is fixed to a support arm 25, 30. The illustrated example includes two adjustment knobs 160, 165 (and corresponding cam feature(s) 175*a*, 175*b*, 180*a*, 180*b*) to adjust two back supports 10, 15. However, any number of adjustment knobs and corresponding features may be implemented to adjust any number of back supports.

Figure 16:
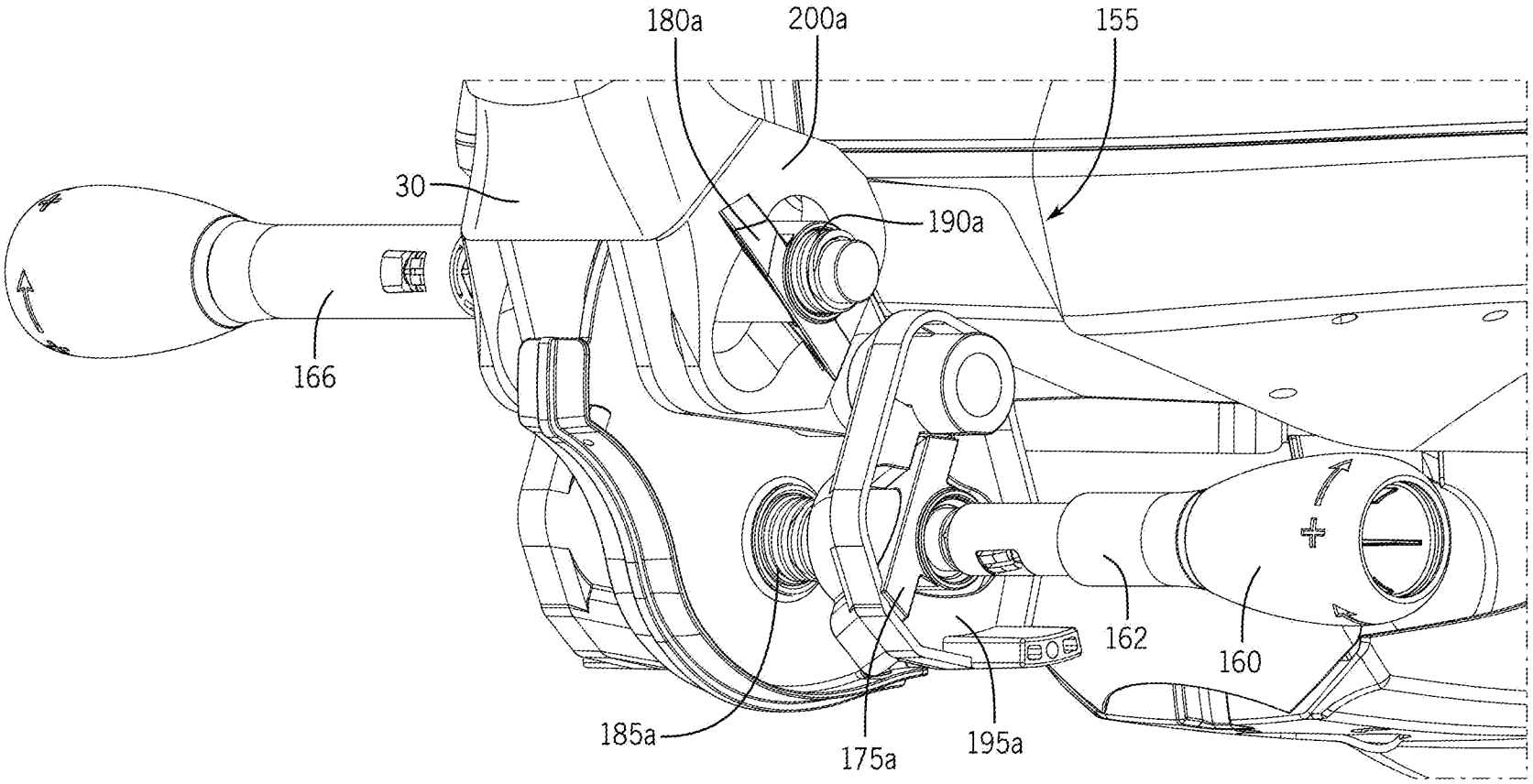
FIG. 16 depicts an additional more detailed view of the example back angle adjustment mechanism of FIGS. 13-15.
Figure 17:
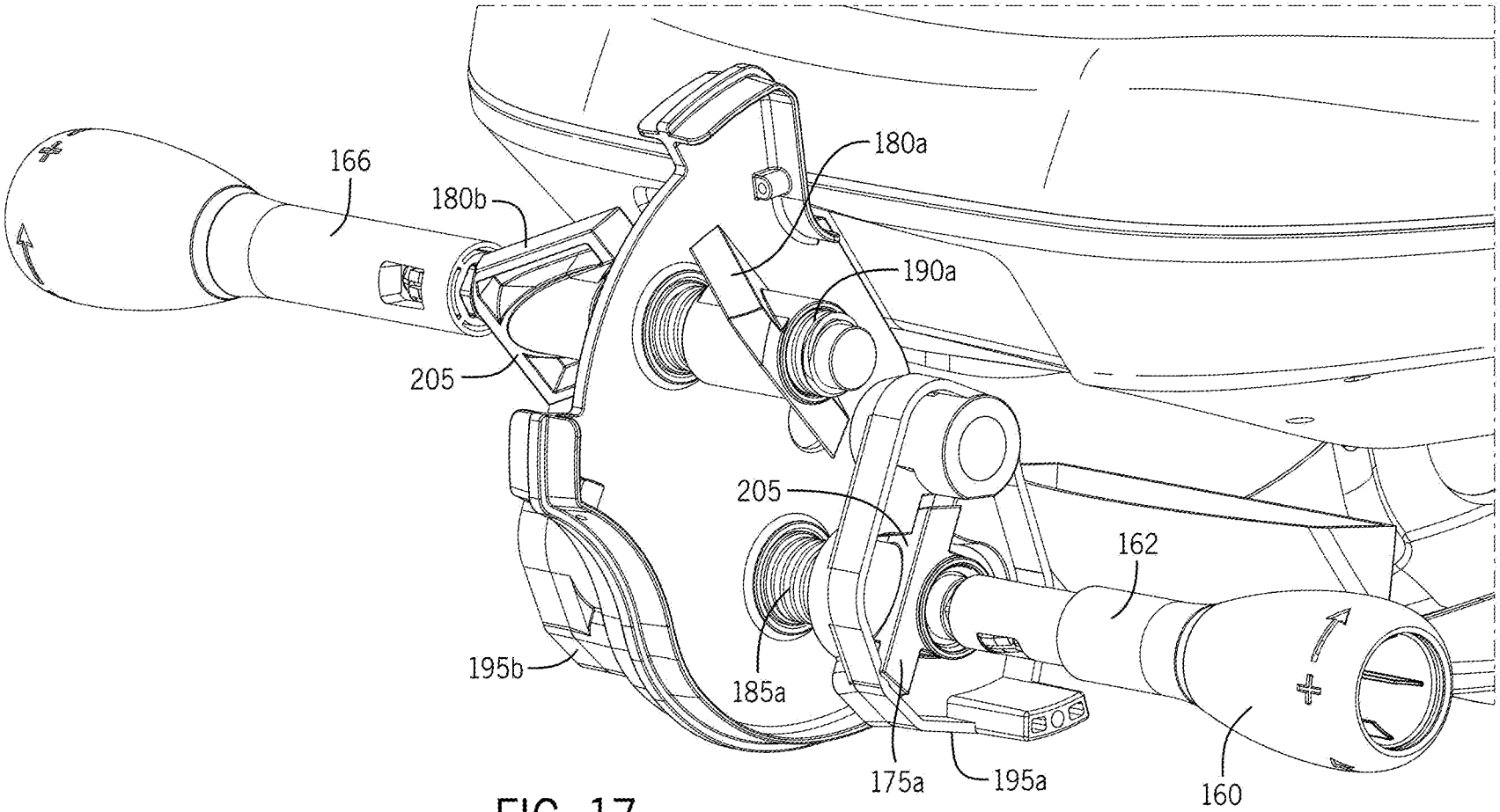
FIG. 17 is another more detailed view of the example back angle adjustment mechanism of FIGS. 13-16.
Figure 18:
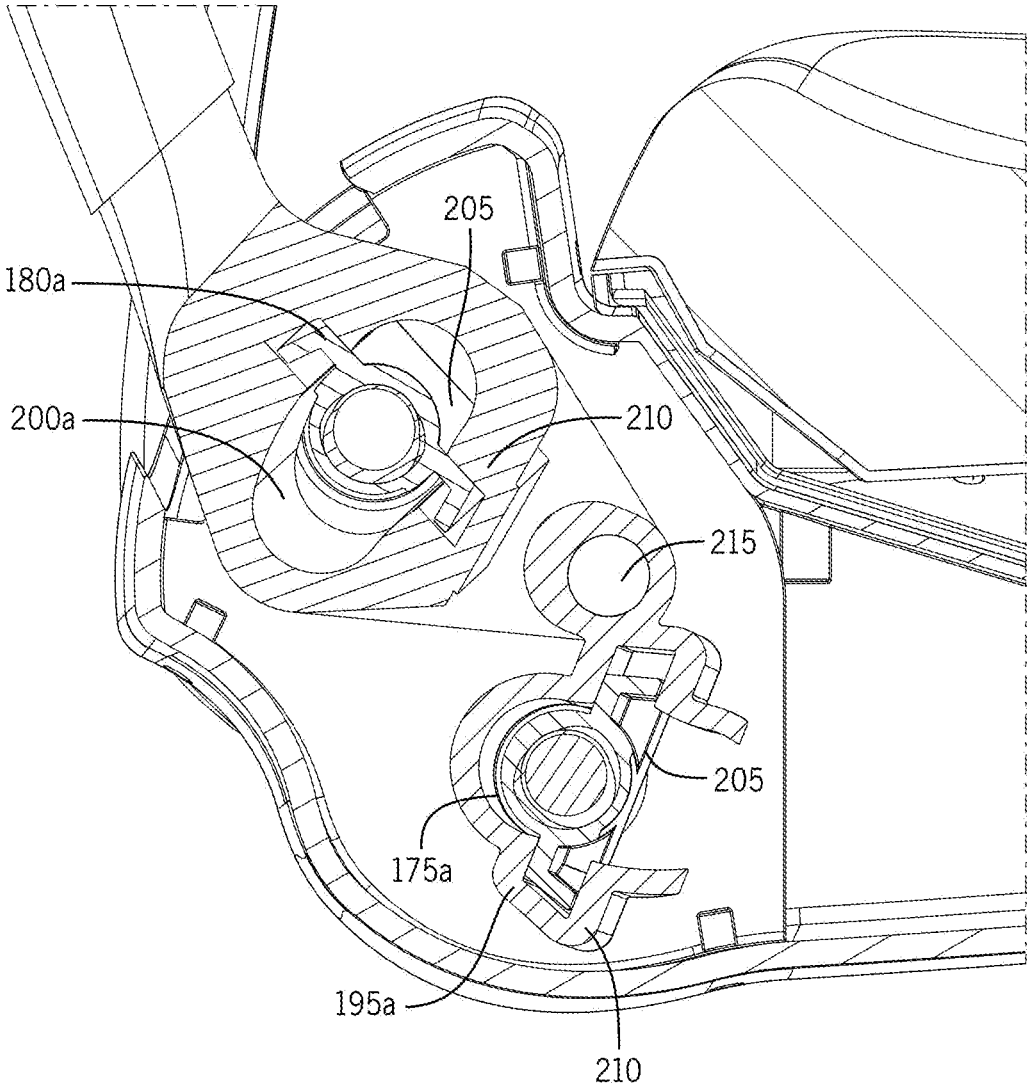
FIG. 18 is a cross-sectional view of the example back angle adjustment mechanism of FIGS. 13-17.

FIGS. 16 and 17 depict additional more detailed views of the example back angle adjustment mechanism 155 of FIGS. 13-15. FIG. 18 is a cross-sectional view of the example back angle adjustment mechanism of FIGS. 13-17. FIGS. 16-18 depict two cam features 175*a*, 175*b*, 180*a*, 180*b* corresponding to respective adjustment knobs 160, 165. The cam features 175*a*, 175*b*, 180*a*, 180*b* are each positioned around a threaded portion 185*a*, 185*b*, 190*a*, 190*b* of the respective adjustment rod 162, 166. The cam features 175*a*, 175*b*, 180*a*, 180*b* include an angled surface 205 or surfaces. The angled surface(s) 205 of the cam features 175*a*, 175*b*, 180*a*, 180*b* correspond to angled surface(s) 210 of the cam receivers 195*a*, 195*b*, 200*a*, 200*b*. As the adjustment rod 162, 166 is rotated, the threaded portions 185*a*, 185*b*, 190*a*, 190*b* of the rod 162, 166 interact with corresponding threaded portions of the cams 175*a*, 175*b*, 180*a*, 180*b*, thereby linearly moving the cam feature(s) 175*a*, 175*b*, 180*a*, 180*b* in opposing inward and outward directions within the corresponding cam receivers 195*a*, 195*b*, 200*a*, 200*b*. Moving the cam features 175*a*, 175*b*, 180*a*, 180*b* causes rotation of the corresponding cam receivers 195*a*, 195*b*, 200*a*, 200*b* (which are coupled to the respective support arms), thereby rotating the respective support arm 25, 30. The cam features 175*a*, 175*b*, 180*a*, 180*b* and cam receivers 195*a*. 195*b*, 200*a*, 200*b* are fitted in such a way that the cam 175*a*, 175*b*, 180*a*, 180*b* moves laterally within the cam receiver 195*a*, 195*b*, 200*a*, 200*b* as the adjustment rod 162, 166 is rotated. The interaction between the angled surfaces 205, 210 results in the rotation of the support arms 25, 30.

Additionally, FIG. 18 depicts an opening 215 through which a pin or rod is positioned, creating a single axis of rotation for both support arms. This pin or rod extends through or into apertures in both first and second support arms. The pin or rod may also be operative to couple the support arms 25, 30 to respective brackets extending from a base 20 or seat pan of the chair 5. While the interaction of the cam features 175*a*, 175*b*, 180*a*, 180*b* and cam receivers 195*a*, 195*b*. 200*a*, 200*b* dictates the degree of rotation of each of the respective support arms 25, 30, the supports arms rotate 25, 30 about the pin (e.g., a central axis of the pin). Thus, the support arms 25, 30 rotate about a single pivot axis. Alternatively, the support arms 25, 30 may be coupled to the chair 5 in a way such that the support arms rotate about separate pins or axis.

One or more of the disclosed embodiments, alone or in combination, may provide one or more technical effects including a more customizable chair back to increase the comfort of the user. The technical effects and technical problems in the specification are exemplary and are not limiting. It should be noted that the embodiments described in the specification may have other technical effects and can solve other technical problems.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom," "left" and "right") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only, and not limiting. Although only a few embodiments have been described in detail in this disclosure, those skilled in the art who review this disclosure will readily appreciate that many various alternatives, modifications, variations, improvements and/or substantial equivalents, whether known or that are or may be presently foreseen, are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes, and omissions may be made in the design, operating conditions, and arrangement of the various examples of embodiments without departing from the spirit or scope of the present inventions. Therefore, the invention is intended to embrace all known or earlier developed alternatives, modifications, variations, improvements and/or substantial equivalents.

The invention claimed is:

1. A chair including:
- a first back support;
- first support arms to connect the first back support to a base of the chair;
- a second back support;
- a second support arm to connect the second back support to the base of the chair, the second back support being independently rotatable from the first back support, support; and
- an angle adjustment mechanism to enable adjustment of the angle of at least one of the first support arms or the second support arm, wherein the angle adjustment mechanism includes a cam and wherein the first and second back supports rotate about a single axis.

2. The chair of claim 1, wherein a height of the first back support is adjustable.

3. The chair of claim 1, wherein a height of the second back support is adjustable.

4. The chair of claim 1, wherein the first back support is pivotable about a first end of the first support arms.

5. The chair of claim 1, wherein the second back support is pivotable about a first end of the second support arm.

6. The chair of claim 1, further including an additional angle adjustment mechanism to enable adjustment of the angle of the other one of the first support arms or the second support arms.

7. The chair of claim 1, wherein the angle adjustment mechanism includes a rotatable knob.

8. The chair of claim 1, wherein the angle adjustment mechanism includes a lever.

9. The chair of claim 1, wherein the angle adjustment mechanism includes a clutch plate.

10. A chair including:
- a first back support;
- first support arms to connect the first back support to a base of the chair;
- a second back support;
- a second support arm to connect the second back support to the base of the chair, the second back support being independently rotatable from the first back support; and
- an angle adjustment mechanism to enable adjustment of the angle of at least one of the first support arms or the second support arm, wherein the angle adjustment mechanism includes a clutchplate and wherein the first and second back supports rotate about a single axis.

11. The chair of claim 10, wherein a height of the first back support is adjustable.

12. The chair of claim 10, wherein a height of the second back support is adjustable.

13. The chair of claim 10, wherein the first back support is pivotable about a first end of the first support arms.

14. The chair of claim 10, wherein the second back support is pivotable about a first end of the second support arm.

15. The chair of claim 10, further including an additional angle adjustment mechanism to enable adjustment of the angle of the other one of the first support arms or the second support arms.

16. The chair of claim 10, wherein the angle adjustment mechanism includes a rotatable knob.

17. The chair of claim 10, wherein the angle adjustment mechanism includes a lever.

* * * * *